United States Patent [19]

Aldana

[11] 4,123,811

[45] Nov. 7, 1978

[54] CONVERTIBLE SOFA BED AND COVER

[75] Inventor: Elphious Aldana, Los Angeles, Calif.

[73] Assignee: Kustom Fit Manufacturing Company, South Gate, Calif.

[21] Appl. No.: 850,774

[22] Filed: Nov. 11, 1977

[51] Int. Cl.[2] ..... A47C 17/16

[52] U.S. Cl. ..... 5/43; 5/17; 5/37 R; 5/44 R

[58] Field of Search ..... 5/12, 13, 17, 28, 18 R, 5/37 R, 43–45

[56] References Cited

U.S. PATENT DOCUMENTS

| | | | |
|---|---|---|---|
| 3,422,467 | 1/1969 | Nibing | 5/44 R |
| 3,656,189 | 4/1972 | Nibing | 5/45 |
| 3,932,902 | 1/1976 | Belk | 5/13 |
| 4,048,680 | 9/1977 | Rogers, Jr. | 5/37 R |

*Primary Examiner*—Casmir A. Nunberg

*Attorney, Agent, or Firm*—Fulwider, Patton, Rieber, Lee & Utecht

[57] ABSTRACT

A convertible sofa bed and cover particularly adapted for use in recreational vehicles. The bed includes a frame, a seat portion including a seat cushion, a back portion including a back cushion and adapted to be moved between a horizontal bed position and an upright sofa position, and a pivot apparatus for pivoting the back portion between the bed position, in which the seat and back cushions abut, and the sofa position, in which the lower terminus of the back cushion is located above and forwardly of the rearward terminus of the seat cushion. The bed includes a flexible cover attached to the upper or support surfaces of the seat and back cushions to cover the juncture or crevice between them in their bed position. The cover is attached to the seat cushion forwardly of the juncture and extends rearwardly to form a flap which covers the lower face of the back cushion when the back cushion is in its sofa position.

4 Claims, 9 Drawing Figures

FIG. 5
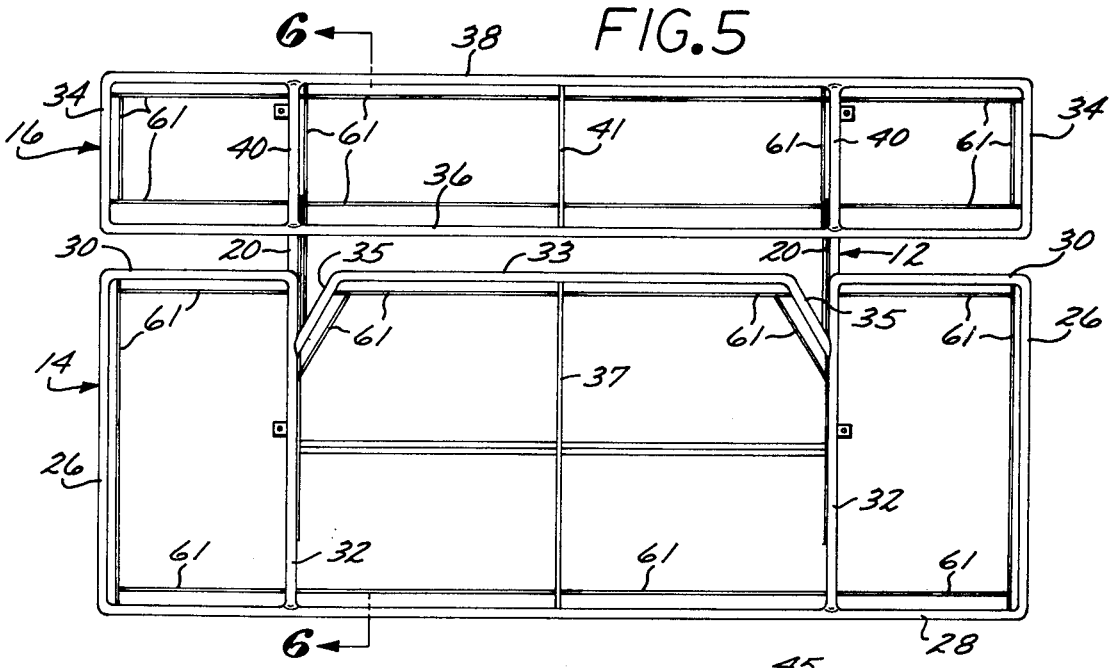
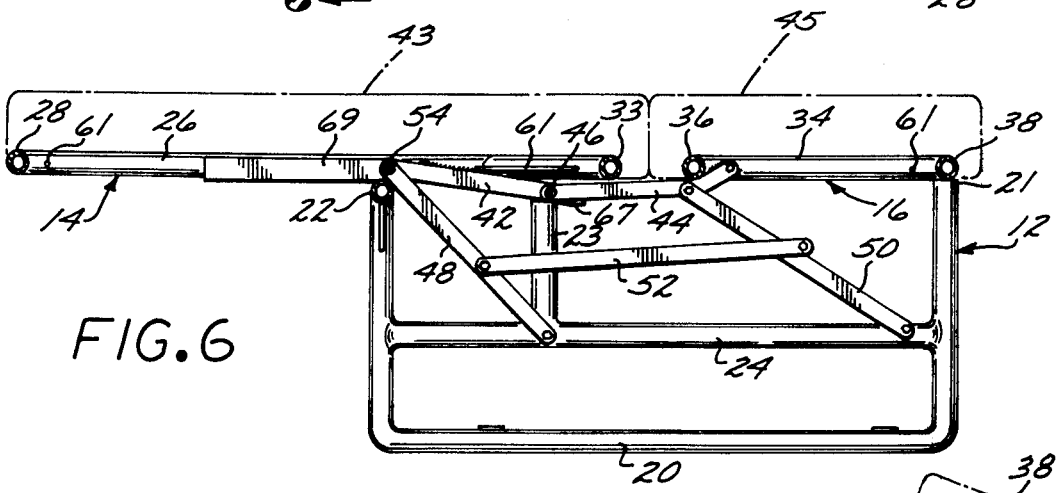
FIG. 6
FIG. 7
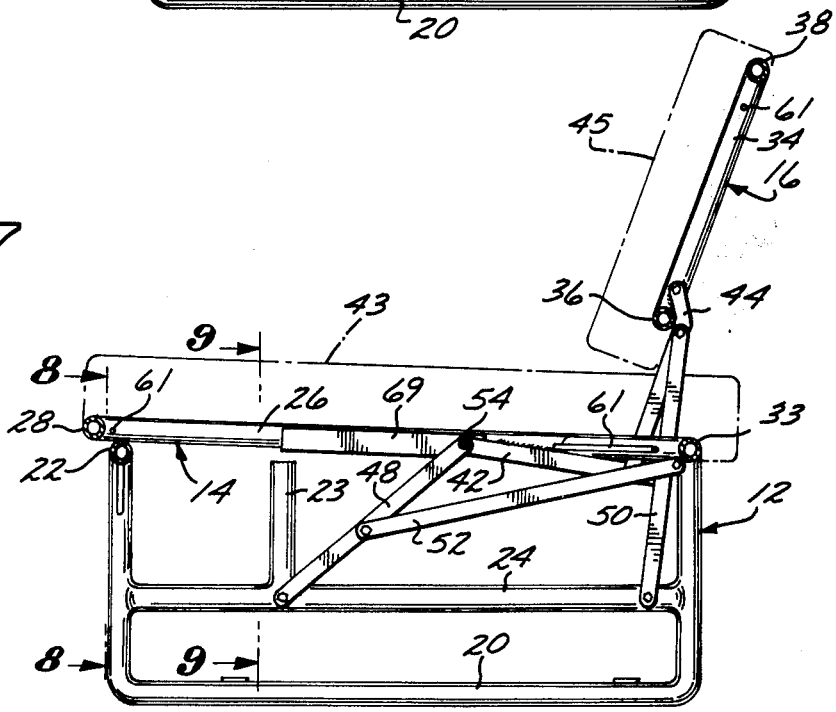

CONVERTIBLE SOFA BED AND COVER

BACKGROUND OF THE INVENTION

1. Field of the Invention

The present invention relates to a convertible sofa bed and more particularly to a sofa bed adapted for use in vehicles.

2. Description of the Prior Art

There are various sofa beds in the prior art which are convertible from a sofa to a bed structure. Such sofa beds utilize a variety of linkages to effect the conversion. Certain of these, including the sofa bed of U.S. Pat. No. 3,932,902, issued Jan. 20, 1976 and entitled "Convertible Sofa Bed," are directed to linkage systems operative to move the seat back from its bed position to its sofa position without striking the wall or other surface immediately behind the bed. That is, the most rearward portion of the seat back moves in a generally vertical line during its movement between the bed and sofa positions. In such a sofa bed the cushions necessarily must be horizontally oriented and abut against one another in the bed position. Further, to provide a more compact arrangement of the cushions in the sofa position, it is desirable for the back cushion to rest upon and forwardly of the rearward terminus of the seat cushion rather than being tucked behind the rearward terminus. However, such an arrangement poses a problem in that heretofore there has been no convenient way of covering the juncture or crevice existing between the abutting seat and back cushions in their bed position. The lack of a covering to bridge the crevice and provide support to the user makes the bed uncomfortable. Moreover, in the sofa position the crevice is a catchall for debris and articles falling onto the back of the seat. Such material eventually finds its way through the crevice and onto the floor beneath the sofa bed.

SUMMARY OF THE INVENTION

According to the present invention, a convertible sofa bed and cover is provided which includes a back portion which is pivotally connected to a seat portion by pivot means operative to orient the back portion in a horizontal bed position or in a generally upright sofa position.

The seat and back portions include cushions which abut in the bed position. In the sofa position the back portion is located above and forwardly of the rearward terminus of the seat portion.

A flexible cover is attached to the seat cushion along a seam located forwardly of the rearward terminus of the seat cushion. This cover extends to the forward terminus of the back cushion and the intervening portion of the cover is unattached to either of the cushions. This intervening portion defines a flap which overlies the crevice formed between the cushions in their bed position. Thus, the flap supports the user in such a way that he is unaware of the crevice and the cushions appear to be one continuous cushion. In the sofa position the cover flap lies across the forward or lower portion of the back cushion, providing an attractive closure and concealment of the juncture between the cushions. The continuous nature of the flap also prevents debris and articles from passing between the cushions and onto the floor.

Other objects and features of the invention will become apparent from consideration of the following description taken in connection with the accompanying drawings.

BRIEF DESCRIPTION OF THE DRAWINGS

FIG. 5 is a plan view of the sofa bed of FIG. 1 in its bed position, with the cushions and other upholstery removed;

FIG. 6 is a view taken along the line 6—6 of FIG. 5, the cushions being illustrated in phantom outline;

FIG. 7 is a view similar to FIG. 6, but illustrating the sofa bed in its sofa position;

DESCRIPTION OF THE PREFERRED EMBODIMENT

Figure 1:
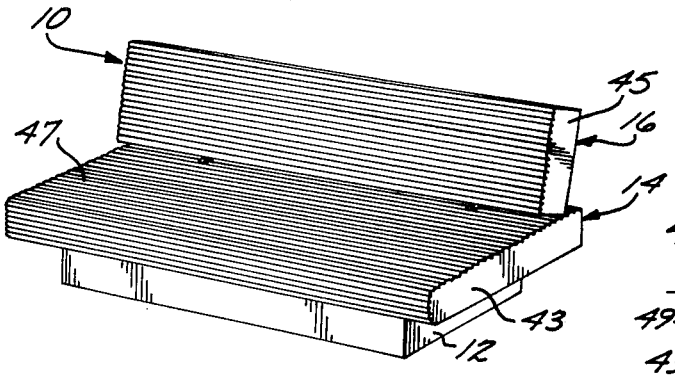
FIG. 1 is a perspective view of a convertible sofa bed according to the present invention.
Figure 2:
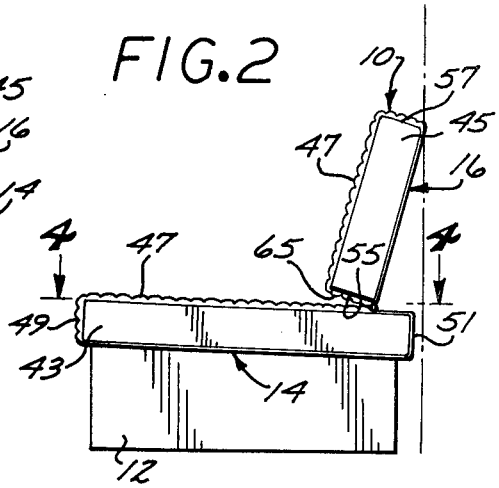
FIG. 2 is an end elevational view of the sofa bed of FIG. 1 in its sofa position.
Figure 3:
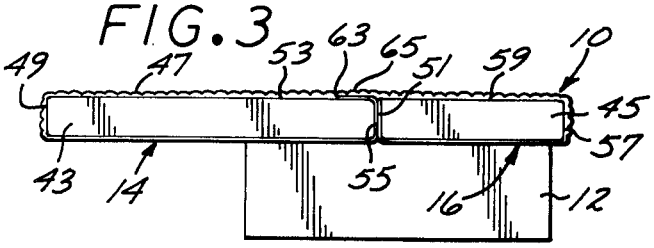
FIG. 3 is a view similar to FIG. 2 but illustrating the sofa bed in its bed position.
Figure 4:
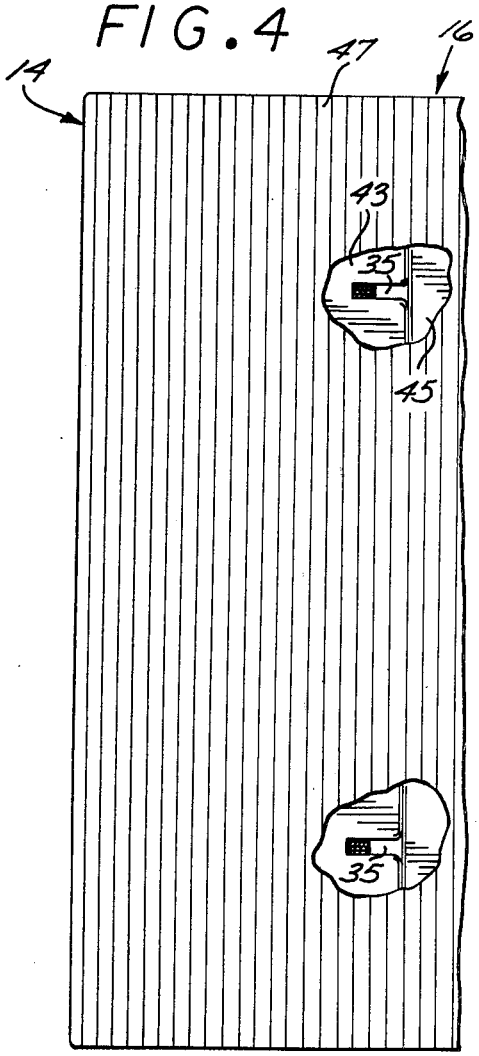
FIG. 4 is an enlarged view taken along the line 4—4 of FIG. 2, portions of the cushion upholstery being cut away to show the location of portions of the pivot assemblies.
Figure 8:
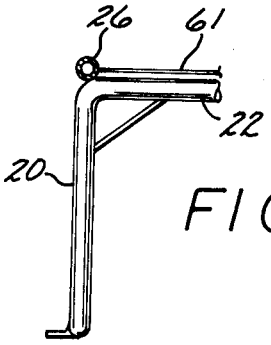
FIG. 8 is a detailed view taken along the line 8—8 of FIG. 7.
Figure 9:
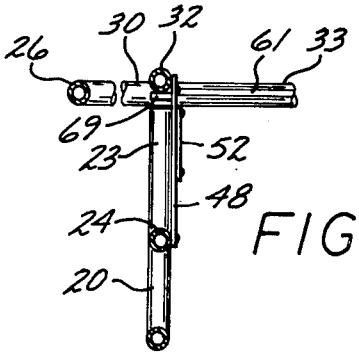
FIG. 9 is a detailed view taken along the line 9—9 of FIG. 7.

Referring now to the drawings, there is illustrated a convertible sofa bed 10 according to the present invention and comprising, generally, a frame 12; a seat portion 14 overlying the frame 12; and a back portion 16 also overlying the frame 12 and pivotally connected to the seat portion 14 for pivotal movement between the sofa position illustrated in FIG. 2 and the bed position illustrated in FIG. 3.

In the sofa position of FIG. 2, the seat portion 14 is generally horizontally oriented, having a slight upward or forward slope for comfort. The back portion 16 is generally vertical or upright, having a slight backward tilt. In the bed position of FIG. 3, the seat and back portions 14 and 16 are both generally horizontal and are arranged in co-planar, abutting relation.

In moving from the sofa position of FIG. 2 to the bed position of FIG. 3, the seat and back portions 14 and 16 are projected forwardly, that is, to the left as viewed in FIGS. 2 and 3, as the back portion 16 pivots from its upright to its horizontal position. This forward projection is coordinated with the upward and downward movement of the upper end of the back portion such that it tends to move generally vertically. Consequently the sofa bed 10 can be located relatively close to a wall or the like since the back portion 16 moves between its sofa and bed positions in a generally vertical path without any need to move the sofa bed 10 away from the wall. This is particularly advantageous where the sofa bed 10 is to be used in a confined space such as within a motor home or similar vehicle.

In moving to the sofa position the back portion 16 not only moves upwardly of the seat portion 14, but also forwardly of the rearward terminus of the seat portion 14, as best seen in FIG. 2.

The structure of the frame 12, seat and back portions 14 and 16, and the mechanisms employed to pivot the seat and back portions 14 and 16 between their bed and sofa positions are somewhat similar to the corresponding elements of the convertible sofa bed described in the aforementioned U.S. Pat. No. 3,932,902.

More particularly, the frame 12 may take any configuration suitable for support of the seat and back portions 14 and 16. Preferably the frame 12 and portions 14 and 16 are made of lightweight structural tubing or the like. The frame 12 includes U-shaped side members 20, joined in front by a horizontal, transversely extending integral front element 22. The pair of legs or uprights of each of the side members 20 are joined by an elongated horizontal brace 24 which extends from front to rear generally parallel to the base portion of the associated U-shaped side member 20.

A horizontal tab or plate 21 is welded to the top of each of the rear uprights of the side members 20 to support the back portion 16 in its bed position, as will be seen. One of the plates 21 is seen in FIG. 6. In addition, a pair of vertically oriented tubular supports 23 are welded at their lower extremities to the cross braces 24 nearer the forward ends of the braces 24 to provide support and rigidity in the bed position of the sofa bed, as will be seen.

The side members 20 are provided with any suitable means for attachment of the sofa bed to the floor of the supporting structure, as will be apparent, and details of such attachments are omitted for brevity.

The generally rectangular seat portion 14, which extends laterally outwardly of the side members 20 of the frame 12, is defined by a pair of side elements 26 integrally joined at their forward extremities by a transversely extending front element 28. The seat portion 12 also includes a pair of intermediate elements 32 welded to the front element 28 and extending rearwardly in parallel, generally vertical alignment with the side members 20 of the frame 12.

A pair of transversely extending rear elements 30 integrally join the rearward extremities of the side elements 26 and the adjacent intermediate elements 32. A third rear element 33 is arranged parallel to the rear elements 30, and its end extremities are outwardly deformed or bent at an angle to define triangular pivot openings 35, as seen in FIG. 5, the ends of the rear element 33 being welded to the intermediate elements 32 forwardly of the rearward ends of the elements 32. Structural rigidity of the seat portion 14 is improved by a horizontal cross bar 37 which is generally parallel to and located between the intermediate elements 32, the ends of the bar 37 being welded to the rear element 33 and the front element 28.

The construction of the generally rectangular back portion 16 is substantially identical to that of the seat portion 14, including side elements 34 integrally joined by front and rear elements 36 and 38. The back portion 16 also includes a pair of intermediate elements 40 and a cross bar 41 which are welded to the front and rear elements 36 and 38 in general alignment with the side members 26 and the cross bar 37 of the seat portion 14, as best seen in FIG. 5.

The frame 12 and seat portions 14 and 16 may be upholstered in any suitable manner, but typically include a seat cushion 43 attached to the seat portion 14 and a back cushion 45 attached to the back portion 16. The cushions are generally rectangular and can be made of foam or other suitable structure covered by a flexible material such as cloth fabric, vinyl plastic or the like. The cushions are usually of appreciable depth for comfort and consequently are characterized by side and end surfaces. More particularly, the cushion 43 includes a generally vertical forward terminus or front edge face 49, a similar rear terminus or edge face 51, and a generally horizontal support surface 53 extending between these edges. The back cushion 45 is similarly characterized by a forward terminus or lower edge face 55, a rearward terminus or upper edge face 57, and a support surface 59 which is horizontally oriented and co-planar with the support surface 53 in the bed position of FIG. 3. The upholstery is attached by any suitable means to attachment structure of the sofa bed. Such structure may take the form of attachment rods 61 welded to the seat and back portions 14 and 16 adjacent their perimeters, as best viewed in FIG. 5.

A flexible cover 47 overlies the juncture or crevice between the cushions 43 and 45 in the bed position of FIG. 3 and preferably also extends across the front edge face 49, the support surfaces 53 and 59, and the upper edge face 57 in the bed position of the sofa bed 10, as seen in FIG. 3. The cover 47 may be made an integral part of other upholstery for the cushions, or it may overlie such upholstery and be secured thereto. In any event, the cover 47 is fixed in position relative to the cushion 43 along a line or seam running parallel to and located forwardly of the rear edge face 51. The cover 47 can be fixed in this position either by attachment to the cushion itself or by attachment to associated upholstery overlying the cushion 43. It is important primarily that the cover 47 be fixed in position upon the support surface 53 along the seam 63. In addition the cover 47 is similarly fixed in position relative to the cushion 45, but is not attached to the lower edge face 55.

With reference to FIG. 3, the loose or unattached portion of the cover 47 which extends between the seam 63 and the lower edge face 55 of the back cushion 45 defines a flap 65 which is movable relative to the cushions. As seen in FIG. 2, this arrangement permits the flap to overlie and cover the lower edge face 55 of the back cushion 45 in the sofa position of the sofa bed 10.

With the foregoing arrangement, the flap 65 bridges across the crevice between the faces 51 and 55 in the bed position of the sofa bed 10 for greater comfort to the user, and yet is freely movable to underlie and cover the lower edge face 55 when the back portion 16 is raised and projected forwardly by the pivot mechanisms of the sofa bed. In both the sofa and bed positions the arrangement enables use of a continuous cover 47 overlying the cushions from the front edge face 49 to the upper edge face 57 in an aesthetically attractive fashion.

The hinging or pivotal mechanisms for pivoting the seat and back portions 14 and 16 relative to one another and relative to the frame 12 include at each side of the frame 12 a pair of straps 42 and 44 located in general vertical alignment with the frame side members 20. Each strap 42 is welded at one extremity to the adjacent intermediate element 32 of the seat portion 14, while the associated strap 44 is similarly welded at one extremity to the intermediate element 40 of the back portion 16.

The adjacent extremities of each pair of straps 42 and 44 are pivotally connected by a pin 46 which defines a hinge axis about which the portions 14 and 16 pivot relative to one another. The end of each strap 42 includes an offset tab 67 which engages the underside of the associated strap 44 in the bed position of the sofa bed 10, acting as a stop to limit movement of the seat and back portions 14 and 16 beyond the positions illustrated in FIG. 6.

The pivot assemblies each also comprise a front pivot arm 48 having a lower extremity pivotally connected to a side brace 24, and an upper extremity pivotally connected to the vertical leg of an angle 69 which is welded to the adjacent one of the intermediate elements 32, as best seen in FIGS. 6 and 7. The angle 69 provides structural rigidity, and its horizontal leg is adapted to rest upon the frame front element 22 in the bed position of FIG. 6 to transmit operating loads to the frame 12 in conjunction with the arm 48.

Each of the pivot assemblies further includes a rear pivot arm 50, having a lower extremity pivotally connected to the adjacent brace 24 at a point located rearwardly of the corresponding connection of the arm 48 to the brace 24. The upper extremity of the arm 50 is pivotally connected to the strap 44 of the back portion front element 36, as best seen in FIGS. 6 and 7. In the bed position of FIG. 6, the lower extremity of the arm 50 is forwardly projected, while in the sofa position of FIG. 7 the arm 50 is nearly vertically oriented to project the back portion 16 upwardly of the seat portion 14 and forwardly of the rearward terminus of the seat portion 14.

Each pivot assembly also includes an elongated connecting link 52 having a forward extremity pivotally attached to the front pivot arm 48, and a rearward extremity pivotally attached to a tab (not shown) welded to the rear pivot arm 50. The arm 50 constrains the arms 48 and 50 against movement independently of one another in a manner generally analagous to a parallelogram linkage.

The operation of the pivot assemblies just described produces a relatively rapid upward pivotal movement of the back portion 16 during its movement from the bed to the sofa position. In addition, upon movement of the back portion 16 to the bed position, the back portion 16 is engaged upon and is supported by the plates 21 of the frame 12, with the upper extremities of the straps 42 and 44 resting upon the upper end of the supports 23.

The forward projection or movement of the back portion 16 during its movement from its bed to its sofa position is preferably just sufficient to urge the cover flap 65 upwardly from the seat cushion 43 and neatly against the back cushion lower edge face 55.

A torsion rod 54 extends transversely of the frame 12 and is welded at its opposite ends to the upper ends of the pivot arms 48, thereby causing the two pivot assemblies at opposite sides of the frame 12 to operate in unison.

The sofa bed of the present invention provides a strong, relatively lightweight and efficient structure readily adapted for use in motor homes and the like. It is particularly characterized by a unique cover arrangement in which a flap portion is adapted in the bed position to overlie and conceal the juncture between the seat and back cushions to provide desirable support to the user, and also adapted to cover portions of the back cushion which would otherwise be exposed when the back cushion is projected upwardly and forwardly into its sofa position. In the sofa position the flap portion also prevents debris and loose articles from passing between the cushions.

Various modifications and changes may be made with regard to the foregoing detailed description without departing from the spirit of the invention.

I claim:

1. In a convertible sofa bed comprising: a frame; a seat portion including a seat cushion having a generally horizontal support surface characterized by a forward terminus and a rearward terminus; a back portion including a back cushion and adapted for movement between a generally horizontal bed position and a generally upright sofa position, said back cushion having, in said bed position, a generally horizontal support surface characterized by a forward terminus; pivot means pivotally connected to said seat and back portions and to said frame, and operative to orient said back portion in said bed position, with said rearward terminus of said seat cushion and said forward terminus of said back cushion in abutment whereby said support surfaces of said back and seat cushions form a substantially continuous horizontal bed surface, said pivot means further being operative to orient said back portion in said sofa position, with said forward terminus of said back cushion located above and forwardly of said rearward terminus of said seat cushion; the improvement comprising:

a flexible cover fixed in position upon said support surface of said seat cushion along a seam located forwardly of said rearward terminus of said seat cushion, said cover extending to the forward terminus of said back cushion and being fixed upon said back cushion, the portion of said cover located between said seam and said forward terminus of said back cushion defining a flap free of attachment and movable relative to said front and back cushions, said cover thereby being exposed to view in both said bed position and said sofa position.

2. In a sofa bed according to claim 1 wherein said cover in said sofa position extends over said support surface of said back cushion and over that portion of said support surface of said seat cushion located forwardly of said seam.

3. In a sofa bed according to claim 1 wherein said back cushion includes a lower edge face in said sofa position, and said flap covers said lower edge face in said sofa position.

4. In a convertible sofa bed including: a frame; a seat portion including a seat cushion having a forward edge face and a generally horizontal support surface characterized by a forward terminus at said forward edge face and a rearward terminus; a back portion including a back cushion and adapted for movement between a generally horizontal bed position and a generally upright sofa position, said back cushion having an upper edge face and a lower edge face in said sofa position, and further having in said bed position a generally horizontal support surface characterized by a forward terminus at said lower edge face; pivot means pivotally connected to said seat and back portions and to said frame, and operative to orient said back portion in said bed position, with said rearward terminus of said seat cushion and said forward terminus of said back cushion in abutment whereby said support surfaces of said back and seat cushions form a substantially continuous horizontal bed surface, said pivot means further being operative to orient said back portion in said sofa position, with said forward terminus of said back cushion located above and forwardly of said rearward terminus of said seat cushion; the improvement comprising:

a flexible cover fixed in position upon said support surface of said seat cushion along a seam located forwardly of said rearward terminus of said seat cushion, said cover in said sofa position extending over said upper edge face, over said support surface of said back cushion, over said lower edge face, over that portion of said support surface of said seat cushion located forwardly of said seam, and over said forward edge face, said cover in said bed position extending over said upper edge face, over said support surfaces of said back and seat cushions, and over said forward edge face, the portion of said cover located between said seam and said forward terminus of said back cushion defining a flap free of attachment and movable relative to said front and back cushions, said flap covering said lower edge face in said sofa position.

* * * * *